US006045132A

United States Patent [19]

Giegerich

[11] Patent Number: 6,045,132

[45] Date of Patent: Apr. 4, 2000

[54] FOLDING BACKBOARD FOR DART GAME

[75] Inventor: Paul Giegerich, Willow Grove, Pa.

[73] Assignee: DMI Sports, Inc., Fort Washington, Pa.

[21] Appl. No.: 09/067,683

[22] Filed: Apr. 28, 1998

Related U.S. Application Data

[60] Provisional application No. 60/044,996, Apr. 28, 1997.

[51] Int. Cl.[7] ..... F41J 01/12

[52] U.S. Cl. ..... 273/408; 273/404; 273/410

[58] Field of Search ..... 273/403, 404, 273/407, 408, 409, 410, 285, 286

[56] References Cited

U.S. PATENT DOCUMENTS 4,281,836 8/1981 Black ..... 273/408

5,540,443 7/1996 Ballan et al. ..... 273/285

*Primary Examiner*—Mark S. Graham
*Assistant Examiner*—M. Chambers
*Attorney, Agent, or Firm*—Akin, Gump, Strauss, Hauer & Feld, L.L.P.

[57] ABSTRACT

A foldable backboard for protecting an area surrounding a dartboard is provided. The backboard includes a pair of generally identically shaped base pieces. Each base piece has a front face, a rear face, is formed of a generally rigid, lightweight material. The base pieces are positioned adjacent to each other. At least one outer layer of flexible material covers the front faces of both of the base pieces and joins the base pieces together along a fold line of the flexible material.

14 Claims, 3 Drawing Sheets

FOLDING BACKBOARD FOR DART GAME

CROSS-REFERENCE TO RELATED APPLICATIONS

This application claims the benefit of U.S. Provisional Application Ser. No. 60/044,996, filed Apr. 28, 1997.

BACKGROUND OF THE INVENTION

The present invention relates to a backboard for use with a dart game and, more particularly, to a foldable backboard.

The use of dartboards for playing a game of darts is generally well known. Such dartboards are generally formed of sisal or some other suitable material adapted for receiving and retaining darts. Dartboards are generally circular in shape and typically are either 15 inches in diameter or 18 inches in diameter.

The use of a standard backboard in conjunction with a dartboard of the type described above is also generally well known. A standard backboard is generally square with sides of approximately 21 inches for use with a standard 15-inch dartboard and with sides of approximately 24 inches for use with a standard 18-inch dartboard. Typically, such prior art backboards are made of a solid material such as particle board or the like and may be painted or covered with a suitable fabric, such as burlap, for an enhanced appearance. Typically, the prior art backboards are designed to be installed directly onto a wall or other location. The prior art backboards also generally include a frame and some type of hanging bracket employed for supporting the backboard thereon. The conventional backboard is very heavy and cumbersome and requires fasteners separate from those of the dartboard for positioning and suspending the backboard onto a wall or other location. As is well known in the art, the purpose of the standard backboard is to protect the wall surrounding the dartboard.

While the standard 21-inch or 24-inch backboards function adequately. for protecting the wall surrounding a dartboard, the conventional backboards are large, heavy, and extremely cumbersome making them difficult and expensive to package, store, and ship.

There is a need for an improved backboard that overcomes the difficulties associated with prior art backboards such as one which is readily foldable into a relatively compact size to facilitate packaging, storage, and shipment. There is also a need for an improved backboard that is easier to install than the currently available backboards.

BRIEF SUMMARY OF THE INVENTION

In a first aspect, the present invention comprises a foldable backboard for protecting an area surrounding a dartboard, the backboard having a pair of generally identically shaped base pieces. Each base piece has a front face and a rear face and is formed of a generally rigid, lightweight material. In assembly, the base pieces are positioned adjacent to each other. At least one outer layer of flexible material covers the front faces of both of the base pieces and joins the base pieces together along a fold line of the flexible material. The flexible material has a shape similar to the shape of the base pieces.

In a second aspect, the present invention comprises a foldable backboard for protecting an area surrounding a dartboard, the backboard having a pair of generally identically shaped base pieces. Each base piece has a front face and a back face, is formed of a generally rigid, lightweight material, and has a generally semi-circular shaped opening along one edge. In assembly, the base pieces are positioned adjacent to each other so that the semi-circular shaped openings face each other to establish a generally circular opening. At least one layer of flexible material covers the front faces of both of the base pieces and joins the base pieces together along a fold line of the flexible material. The shape of the flexible material is generally similar to the shape of the base pieces including a generally circular opening. The dartboard fits within the generally circular opening.

In a third aspect, the present invention further comprises a foldable backboard with numerals placed on an outer surface of the flexible material adjacent the generally circular opening of the base pieces.

BRIEF DESCRIPTION OF THE SEVERAL VIEWS OF THE DRAWINGS

The following detailed description of preferred embodiments of the invention will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
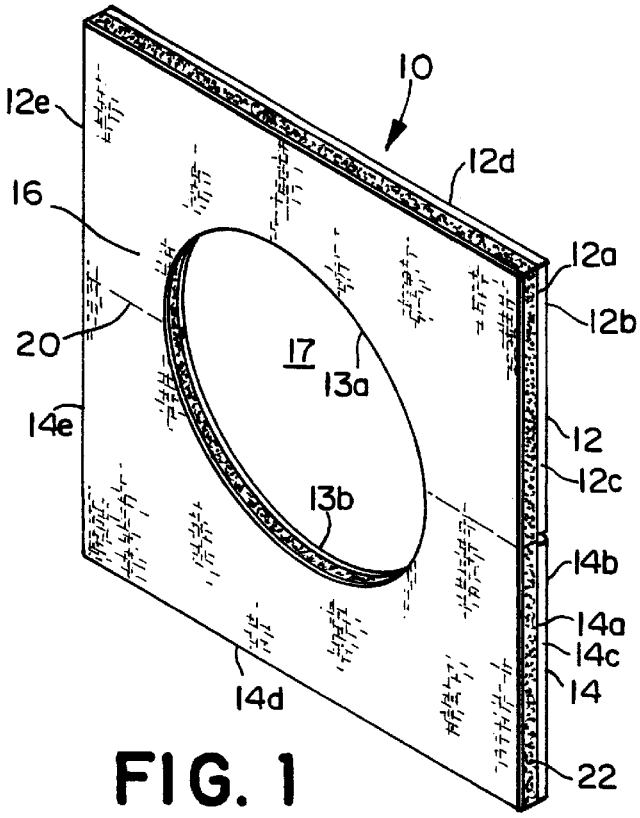
FIG. 1 is a perspective view of a foldable backboard in accordance with a preferred embodiment of the present invention.

Certain terminology is used in the following description for convenience only and is not limiting. The words, "lower", "upper", "left", and "right" designate directions in the drawings to which reference is made. The words "inner" and "outer" refer to layers closest to and furthest from base pieces of the backboard, respectively. The terminology includes the words above specifically mentioned, derivatives thereof and words of similar import.

Figure 2:
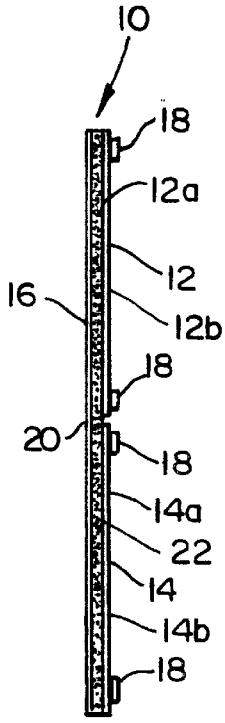
FIG. 2 is a right-side elevational view of the backboard shown in FIG. 1.

Referring now to the drawings in detail, wherein like numerals are used to indicate like elements throughout, there is shown in FIGS. 1–4 a preferred embodiment of a foldable backboard, generally designated 10 in accordance with the present invention. The foldable backboard 10 when in the operating condition as shown in FIGS. 1 and 2 is generally square in shape and preferably has outer sides which are approximately 24 inches in length. It will be appreciated by those of ordinary skill in the art that the foldable backboard 10 could be of some other shape or some other size, if desired.

Referring to FIGS. 1 and 2, the foldable backboard 10 is formed of a pair of generally identically shaped base pieces 12, 14 having front faces 12*a*, 14*a* and rear faces 12*b*, 14*b* respectively. The two base pieces 12, 14 are made of a generally stiff or rigid and lightweight material. A particularly preferred material for the base pieces 12, 14 is particle board because of its relatively lightweight, rigidity, and also because it is manufactured in relatively thin sizes. Other suitable materials for the base pieces 12, 14 include fibreboard, a hardboard composition made from compressed woodchips such as masonite, cork, expanded cellular polystyrene, and plywood. It is understood by those of ordinary skill in the art that the present invention is not limited to constructing the base pieces 12, 14 of any particular material and that other materials having the requisite lightweight, generally stiff characteristics, and dimensions including thinness could be used without departing from the spirit and scope of the invention.

Figure 4:
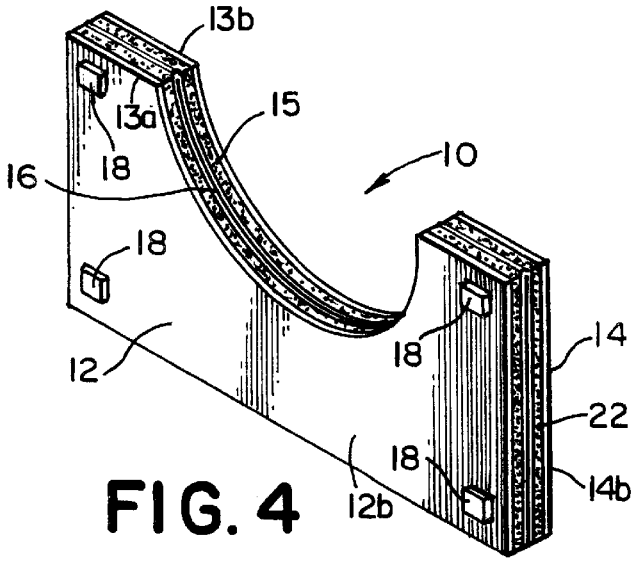
FIG. 4 is a perspective view of the backboard shown in FIG. 1 in a folded condition.

Referring to FIG. 1, the base pieces 12, 14 are placed together as shown to form a generally square outer base perimeter with sides (moving counterclockwise from top right) 12*c*, 12*d*, 12*e*, 14*e*, 14*d*, and 14*c*. In addition, and referring to FIG. 4, the base pieces 12, 14 have generally semi-circular shaped openings 15 along one edge 13*a* and 13*b* of each base pieces 12, 14 respectively as shown in FIGS. 1 and 4. When the base pieces 12, 14 are placed together with edge 13*a* mating with edge 13*b* and the generally semi-circular shaped openings 15 positioned adjacent to each other, a generally circular opening 17 is formed as shown in FIG. 1. The diameter of the generally circular opening 17 of the base pieces is approximately 18 inches for use with the standard 18-inch dartboard. Alternatively, the diameter of the generally circular opening 17 of the base pieces is approximately 15 inches for use with the standard 15 inch dartboard. It is understood by those of ordinary skill in the art that the present invention is not limited to any particular size of the overall backboard and base pieces nor is the invention limited to any particular shape or size of the opening 17 and that other sizes and shapes having the requisite dimensions for use with the dartboard to be protected could be used without departing from the spirit and scope of the invention.

Referring again to FIG. 1, at least one outer layer of flexible material 16 is provided to cover the front faces 12*a* and 14*a* of both of the base pieces 12, 14. The outer layer of flexible material 16 joins the base pieces together along a fold line 20 (shown in phantom in FIG. 1). The outer layer of flexible material 16 has a shape similar to the shape of the base pieces 12, 14 when assembled. As such, the outer layer of flexible material 16 has a generally square outer perimeter and an interior region including a generally circular opening corresponding in size and location to the circular opening 17 so that the generally circular opening 17 of the base pieces 12, 14 is maintained with the flexible material 16. The flexible material 16 includes any suitable material such as but not limited to burlap, felt, flannel, woven materials or any other cloth material. The outer layer 16 may also be foam material, sponge or the like if no additional layers are provided to cushion the board and retard the flight of and capture the dart which misses the dartboard. It is understood by those of ordinary skill in the art that the present invention is not limited to the flexible material 16 being of any particular material and that other materials having the requisite lightweight, and flexibility characteristics could be used without departing from the spirit and scope of the invention.

Figure 3:
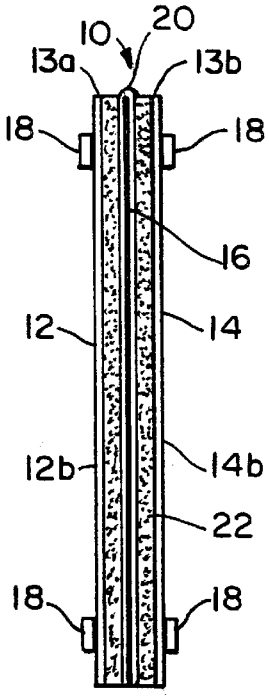
FIG. 3 is a right-side elevational view of the backboard shown in FIG. 1 in a folded condition.

The fold line 20 (shown in phantom in FIG. 1) of the flexible material 16 functions as a fabric hinge as best shown when viewing FIGS. 2 and 3 together. This enables the backboard 10 to be folded upon itself for easy storage as described in more detail below.

Referring again to FIGS. 1 and 2, a second intermediate layer 22 may optionally be employed between the base pieces 12, 14 and the outer layer 16. The second intermediate layer 22 is cut to be of the same general size and shape as the base pieces 12, 14 and outer flexible material 16 and to maintain the generally circular opening 17 created by the aforementioned base pieces 12, 14 and layer 16. The second intermediate layer 22 may be either foldable along a line coincident with fold line 20 of the outer flexible material layer 16 or may be cut along the fold line 17 as can be seen in FIG. 4. The intermediate layer 22 may include such materials as foam or expanded polystyrene such as Styrofoam® commercially available from Dow Chemical, Inc. The purpose of the intermediate layer 22 is to provide cushioning to the overall backboard 10 and to retard the flight of and capture the dart which misses the dartboard. It is understood by those of ordinary skill in the art that the present invention is not limited to the intermediate layer 22 being of any particular material and that other materials having the requisite lightweight characteristics could be used without departing from the spirit and scope of the invention.

The various layers including outer flexible material layer 16 and intermediate layer 22 are secured to the front surfaces 12*a* and 14*a* of the two base pieces 12, 14 of the backboard 10 by an adhesive or some other fastening and securing method.

Referring to FIGS. 2, 3, and 4, if desired, small spacers 18 on the rear faces 12*b* and 14*b* of the base pieces 12, 14 may be employed for maintaining the foldable backboard 10 a predetermined distance from the wall surrounding the dartboard 30 for enhanced protection of the wall and to keep the backboard 10 flush with the front surface of the dartboard it surrounds. The spacers 18 may be made of rubber, wood, polymeric material, or any other suitable material and may be secured to the back surface of the foldable backboard 10 by an adhesive or any other suitable means. It is understood by those of ordinary skill in the art that the present invention is not limited to the spacers 18 or means for securing the spacers to the backboard 10 being of any particular material and that other materials having the requisite characteristics could be used without departing from the spirit and scope of the invention.

Figure 5:
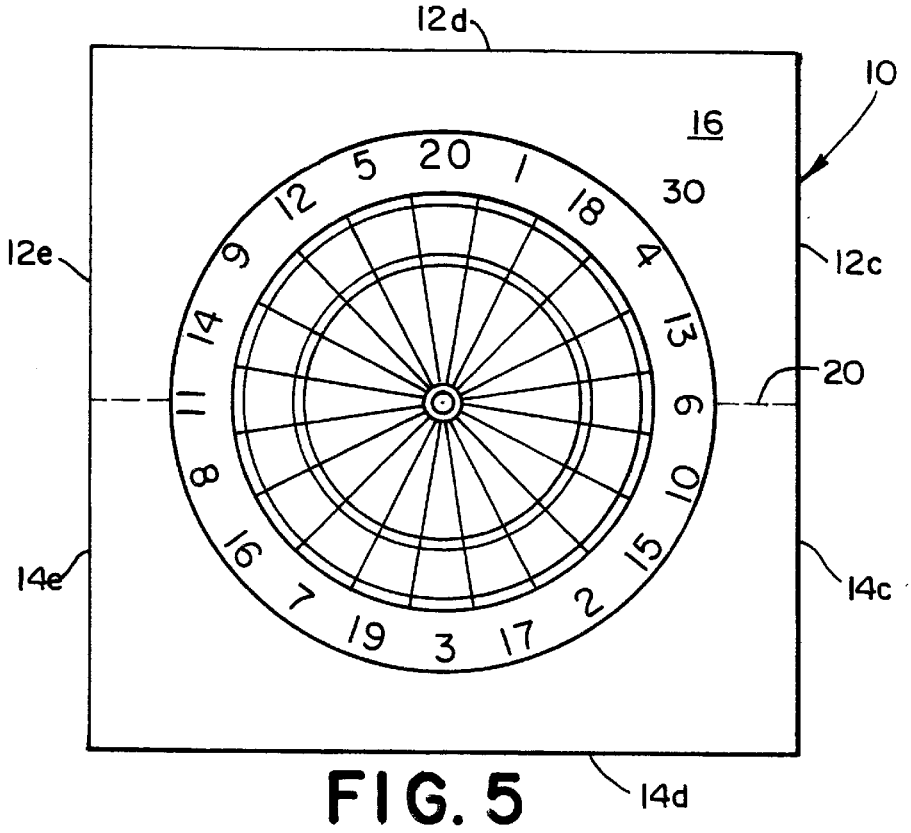
FIG. 5 is a front elevational view of the backboard shown in FIG. 1 when in place on a dartboard.

When the foldable backboard 10 is used in conjunction with an 18 inch dartboard, the diameter of the generally circular opening 17 is at least 18 inches. In this manner, the foldable backboard 10 may be placed over to completely surround a standard 18-inch dartboard 30 as best shown in FIG. 5. Likewise, when the foldable backboard 10 is used with a 15 inch dartboard, the diameter of the opening 17 is at least 15 inches. Typically, the backboard 10 is generally square with sides of approximately 21 inches for use with a standard 15-inch dartboard and with sides of approximately 24 inches for use with a standard 18-inch dartboard. The thickness of the three layered backboard for use with either the 15-inch or 18 inch dartboard with an intermediate layer 22 of foam is approximately 0.63 inches. The weight of a 24 inch square backboard with an intermediate layer 22 of foam is approximately 2 pounds and may in general weigh up to about 6 pounds depending on size and types of materials used. Typically, conventional backboards weigh on the average about 12 pounds. It is understood by those of ordinary skill in the art that the present invention is not limited to the dimensions or weights provided by the sample measured and that other sizes, shapes, dimensions and weight providing the requisite protection to the wall or supporting surface characteristics could be used without departing from the spirit and scope of the invention.

Because of the relative lightweight of the backboard, the foldable backboard 10 may easily be suspended from the dartboard 30 itself rather than securing it to the wall or other supporting surface. The suspension of the backboard directly onto the dartboard eliminates the need for extra fixtures and hanging members typically required for the backboard and also reduces installation time. The folding backboard provides the same degree of protection to a wall surrounding a dartboard 30 as would be provided by a prior art, one-piece, solid backboard.

In addition to the features noted above and as best shown in FIGS. 3 and 4, the dartboard 10 has the desired feature of being foldable. The foldability feature of the backboard 10 provides tremendous savings to handlers of such boards. The overall bulk package to be shipped is approximately half of that required to ship a standard backboard. The reduced size of the packaged foldable backboard reduces the shelf space required for display and storage. Finally because of the reduced size and double thickness of the packaged foldable backboard, there is less opportunity for the unit to be damaged during shipping and handling.

Figure 6:
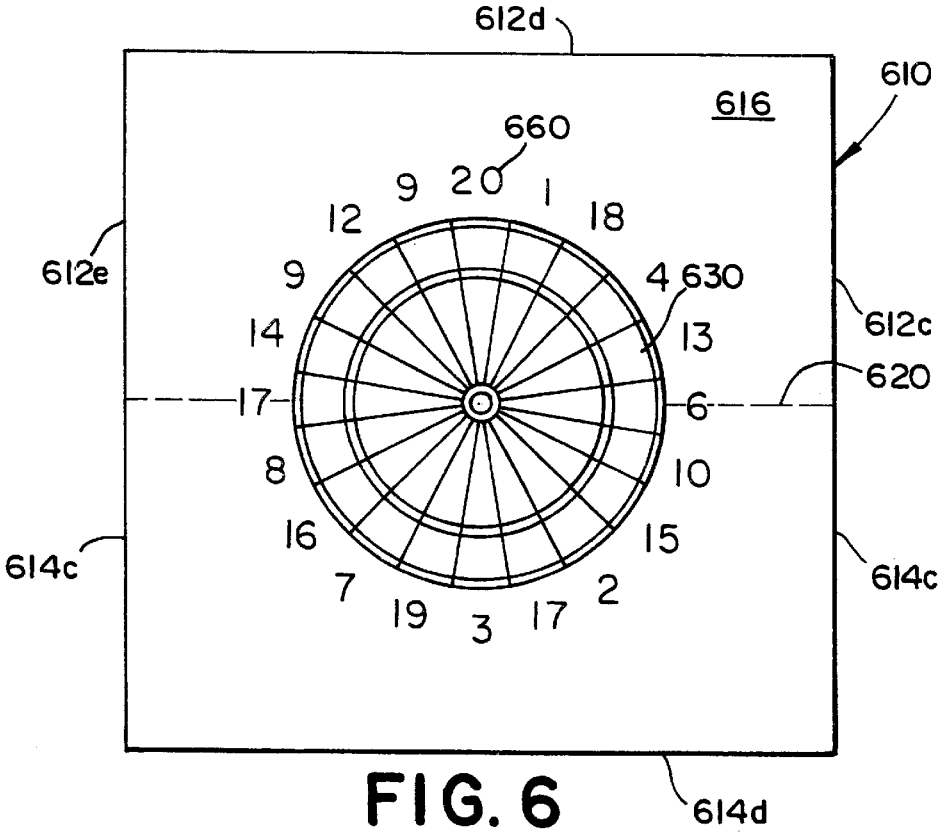
FIG. 6 is a front elevational view of a folding backboard in accordance with an alternate embodiment.

FIG. 6 illustrates an alternate embodiment of the present invention. The foldable backboard 610 of FIG. 6 is substantially the same as that of the foldable backboard 10 shown in FIGS. 1–5 except that the foldable backboard 610 is adapted to be employed with a standard 15-inch dartboard 630 and, therefore, has sides of approximately 21 inches in length. In addition, suitable numerals in Arabic or Roman numerals 660 are applied to the foldable backboard 610 at locations corresponding to the appropriate locations on the dartboard with which the backboard 610 is employed. By providing the numerals 660 directly onto the backboard, the diameter of the dartboard can be reduced thereby leading to a smaller, lighter, and less expensive dartboard yet one that provides the same target area. Like the foldable backboard 10 described above, the foldable backboard 610 is adapted to be supported by the dartboard which it surrounds and may include one or more spacers 618 (not shown) on the rear surface if desired.

Figure 7:
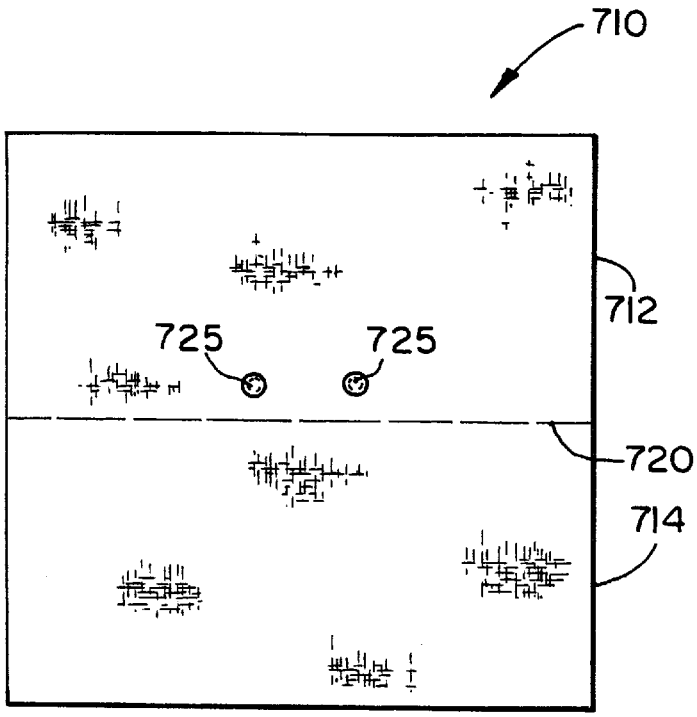
FIG. 7 is a front elevational view of the folding backboard in accordance with a third embodiment of the present invention.

FIG. 7 illustrates a third preferred embodiment of the present invention. The foldable backboard 710 of FIG. 7 is substantially the same as those of the foldable backboards previously described except that the base pieces 712, 714 do not have any generally semi-circular shaped openings. In this embodiment, when the base pieces 712, 714 are placed together with edge 713*a* mating with edge 713*b*, the two base pieces 712, 714 form a solid generally square shaped backboard. The foldable backboard 710 is provided with either one outer layer of flexible material 716 which covers the front faces 712*a* and 714*a* of both base pieces 712,713 or is provided with two layers of flexible material as shown in FIG. 8 similar to those described above.

Figure 8:
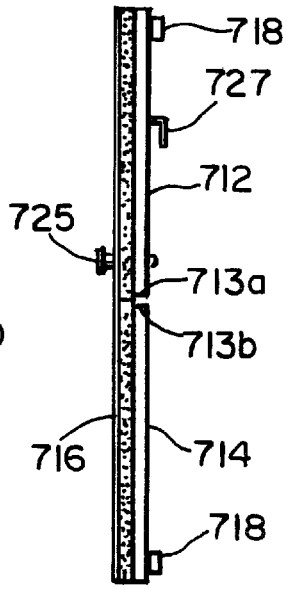
FIG. 8 is a right side elevational view of the backboard shown in FIG. 7.

Referring to FIGS. 7 and 8, at least one outwardly extending fastener 725 is provided on the outer surface of the outer layer of flexible material 716 as a means of attaching a separate dartboard (not shown) to the foldable backboard 710. The separate dartboard is equipped with at least one bracket which slides onto the outwardly extending fastener 725 so that it supports the suspension of the dartboard on the backboard 710, in a manner well known in the art. The brackets of the dartboard are those of the type that are cormmercially available such as hanging brackets commercially available from DMI Sports of Willow Grove, Pa. It is understood by those of ordinary skill in the art that the present invention is not limited any type of fastener or suspension means and that other types of fasteners providing the requisite ability to suspend a dartboard onto the backboard could be used without departing from the spirit and scope of the invention.

Figure 9:
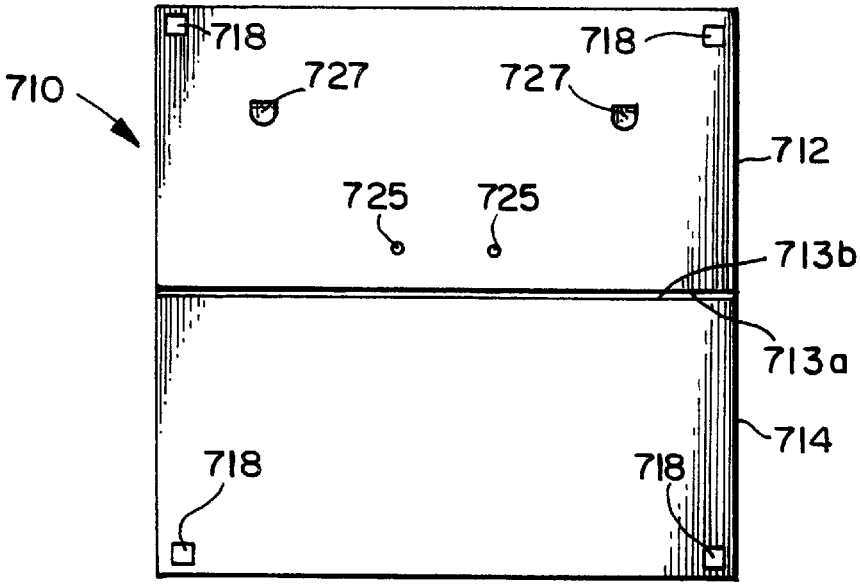
FIG. 9 is a rear elevational view of the folding backboard shown in FIG. 7.

The backboard 710 is attached to the wall with nails, screws or other fasteners through holes (not shown) in the base pieces 712, 714 directly to the wall or supporting surface. The backboard 710 may also be suspended from the wall by at least one suspension fastener 727 such as preferably a generally D-shaped ring that is provided to the rear surface of the base piece 712. FIG. 9 shows the rear face of the backboard 710 provided with two generally D-shaped ring fasteners 727. The D-ring fasteners 727 swivel to catch onto hooks or nails projecting from a wall or other support surface thereby supporting the backboard 710 on the surface. It is understood by those of ordinary skill in the art that the present invention is not limited any type of fastener or suspension means and that other types of suspension means providing the requisite ability to suspend the backboard on a wall or supporting surface could be used without departing from the spirit and scope of the invention.

Referring to FIG. 8, if desired, small spacers 718 on the rear faces 712*b* and 714*b* of the base pieces may be employed for maintaining the foldable backboard 710 a predetermined distance from the wall for enhanced protection of the wall.

It will be appreciated by those skilled in the art that changes could be made to the embodiments described above without departing from the foldable backboard inventive concept thereof. It is understood, therefore, that this invention is not limited to the particular embodiments disclosed but is intended to cover modifications within the spirit and scope of the present invention as defined by the appended claims.

I claim:

1. A foldable backboard for protecting an area surrounding a dartboard comprising:

a pair of generally identically shaped base pieces, each base piece having a front face and a rear face and being formed of a generally rigid, lightweight material, the base pieces being positioned adjacent to each other;

at least one outer layer of flexible material covering the front faces of both of the base pieces and joining the base pieces together along a fold line of the flexible material, the flexible material having a shape similar to the shape of the base pieces; and at least one outwardly extending fastener located on the front face of the outer layer of flexible material whereby a dartboard is suspended from the outwardly extending fastener.

2. A foldable backboard for protecting an area surrounding a dartboard comprising:

a pair of generally identically shaped base pieces, each base piece having a front face and a rear face and being formed of a generally rigid, lightweight material, the base pieces being positioned adjacent to each other;

at least one outer layer of flexible material covering the front faces of both of the base pieces and joining the base pieces together along a fold line of the flexible material, the flexible material having a shape similar to the shape of the base pieces; and a replica of a dartboard with numerals located on the front face of the outer layer of flexible material.

3. A foldable backboard for protecting an area surrounding a dartboard comprising:

a pair of generally identically shaped base pieces, each base piece having a front face and a rear face and being formed of a generally rigid lightweight material, the base pieces being positioned adjacent to each other;

at least one outer layer of flexible material covering the front faces of both of the base pieces and joining the base pieces together along a fold line of the flexible material, the flexible material having a shape similar to the shape of the base pieces; and at least one suspension fastener located on the rear face of the base pieces whereby the backboard is suspended on a supporting surface by the suspension fastener.

4. The foldable backboard for protecting an area surrounding a dartboard comprising:

a pair of generally identically shaped base pieces each base piece having a front face and a rear face and being formed of a generally rigid lightweight material, the base pieces being positioned adjacent to each other, at least one outer layer of flexible material covering the front faces of both of the base pieces and joining the base pieces together along a fold line of the flexible material, the flexible material having a shape similar to the shape of the base pieces; and a plurality of spacers located on the rear faces of the base pieces.

5. A foldable backboard for protecting an area surrounding a dartboard comprising:

a pair of generally identically shaped base pieces, each base piece having a front face and a rear face and being formed of a generally rigid, lightweight material, each base piece having a generally semi-circular shaped opening along one edge, the base pieces being positioned adjacent to each other so that the semi-circular shaped openings face each other to establish a generally circular opening; and at least one outer layer of flexible material covering the front faces of both of the base pieces and joining the base pieces together along a fold line of the flexible material, the flexible material having a shape similar to the shape of the base pieces including a generally circular opening, whereby the dartboard fits within the generally circular opening.

6. The foldable backboard according to claim 5, further comprising a second intermediate layer of material located on the front faces of the base pieces between the base pieces and the outer layer of material, the second intermediate layer having a shape similar to the shape of the base pieces including a generally circular opening.

7. The foldable backboard according to claim 5 further comprising a plurality of spacers located on the rear faces of the base pieces.

8. The foldable backboard according to claim 5 wherein the outer layer of material is secured to the base pieces by an adhesive.

9. The foldable backboard according to claim 5, wherein the outer layer of material is selected from the group comprising felt, burlap, flannel, woven textiles, foam, and sponge.

10. The foldable backboard according to claim 5, wherein the base pieces are selected from the group comprising fibreboard, particle board, cork, a hardboard composition made from compressed woodchips such as masonite, expanded cellular polystyrene, and plywood.

11. The foldable backboard according to claim 6 wherein the intermediate layer of material is selected from the group comprising foam and expanded cellular polystyrene.

12. A foldable backboard according to claim 5 whereby the backboard is supported by the dartboard.

13. A foldable backboard for use with a standard dartboard to protect surrounding wall area comprising:

a pair of generally identically shaped base pieces, each base piece having a front face and a back face and being formed of a generally rigid, lightweight material, each base piece having a generally semi-circular shaped opening along one edge, the base pieces being positioned adjacent to each other so that the semi-circular shaped openings face each other to establish a generally circular opening;

at least one outer layer of flexible material covering the front faces of both of the base pieces and joining the base pieces together along a fold line of the flexible material, the flexible material having a shape similar to the shape of the base pieces including a generally circular opening; and numerals placed on an outer surface of the flexible material adjacent the generally circular opening of the base pieces at locations corresponding to appropriate locations on the dartboard whereby the dartboard fits within the generally circular opening.

14. A foldable backboard according to claim 13 whereby the backboard is supported by the dartboard.

* * * * *